US009999978B2

(12) United States Patent
Awauchi

(10) Patent No.: US 9,999,978 B2
(45) Date of Patent: Jun. 19, 2018

(54) HAIRSTYLING SCISSORS

(71) Applicant: Isao Awauchi, Yoshinogawa (JP)

(72) Inventor: Isao Awauchi, Yoshinogawa (JP)

( * ) Notice: Subject to any disclaimer, the term of this patent is extended or adjusted under 35 U.S.C. 154(b) by 56 days.

(21) Appl. No.: 14/653,244

(22) PCT Filed: Dec. 16, 2013

(86) PCT No.: PCT/JP2013/083675
§ 371 (c)(1),
(2) Date: Jun. 17, 2015

(87) PCT Pub. No.: WO2014/098049
PCT Pub. Date: Jun. 26, 2014

(65) Prior Publication Data

US 2015/0328784 A1 Nov. 19, 2015

(30) Foreign Application Priority Data

Dec. 18, 2012 (JP) ..... 2012-276287

(51) Int. Cl.
*B26B 13/00* (2006.01)
*B26B 13/20* (2006.01)
*B26B 13/12* (2006.01)

(52) U.S. Cl.
CPC ..... *B26B 13/20* (2013.01); *B26B 13/12* (2013.01)

(58) Field of Classification Search
CPC ..... B26B 13/12; B26B 13/20; B26B 13/26; B26B 13/28; B26B 13/24
(Continued)

(56) References Cited

U.S. PATENT DOCUMENTS 193,725 A * 7/1877 Reed ..... B26B 13/24 30/233.5
288,096 A * 11/1883 Morgan ..... B26B 13/20 30/232
(Continued)

FOREIGN PATENT DOCUMENTS

JP S51-130187 U 10/1976
JP H05-001463 U 1/1993
(Continued)

OTHER PUBLICATIONS

International Search Report; PCT/JP2013/083675; dated Jan. 14, 2014.

*Primary Examiner* — Ghassem Alie
*Assistant Examiner* — Bharat C Patel
(74) *Attorney, Agent, or Firm* — Studebaker & Brackett PC

(57) ABSTRACT

The hairstyling scissors have a first scissor piece, a second scissor piece, and a pivot axis that connects the first and second scissor pieces, allowing those pieces to rotate mutually in an unimpeded fashion. The first scissor piece is a long narrow piece having a first blade section positioned ahead of the pivot axis, and a first handle section positioned on the gripping-side of the pivot axis with a first finger eyelet. The first handle section is bent over and beyond the pivot axis towards the first blade section. The second scissor piece is a long narrow piece having a second blade section positioned ahead of the pivot axis, and a second handle section positioned on the gripping-side of the pivot axis with a second finger eyelet. The second handle section is bent over and beyond the pivot axis into the side of the second blade section.

11 Claims, 12 Drawing Sheets

(58) Field of Classification Search
USPC ..... 30/232, 255, 254, 271, 341
See application file for complete search history.

(56) References Cited

U.S. PATENT DOCUMENTS 354,363 A * 12/1886 Titus ..... B26B 13/20 30/232
430,677 A * 6/1890 Pearsall ..... B26B 13/20 30/341
590,330 A * 9/1897 Nolan ..... B26B 13/06 30/254
753,919 A * 3/1904 Rowe ..... B26B 13/00 30/138
2,126,699 A * 8/1938 Florian ..... B26B 13/005 30/161
2,540,255 A * 2/1951 Graves ..... A01D 46/247 30/193
2,571,675 A * 10/1951 Bray ..... B26B 13/20 30/254
2,744,324 A * 5/1956 Chuba ..... B26B 13/24 30/271
2,808,647 A * 10/1957 Ikeuchi ..... B23D 29/026 30/253
3,438,130 A * 4/1969 Edgell ..... A01G 3/065 30/235
3,721,245 A * 3/1973 Campbell ..... A61B 17/3201 30/233
4,146,961 A * 4/1979 Pinto ..... B26B 13/20 30/271
4,285,344 A * 8/1981 Marshall ..... A61B 17/3201 30/257
4,642,895 A * 2/1987 Gauvry ..... B26B 13/20 30/271
4,742,617 A * 5/1988 Gauvry ..... B26B 13/20 30/232
5,060,381 A * 10/1991 Taberlet ..... B26B 13/24 30/194
5,109,608 A * 5/1992 Pracht ..... B26B 13/20 30/232
5,125,159 A * 6/1992 Brenton ..... B26B 13/24 30/232
5,459,929 A * 10/1995 Linden ..... B26B 13/18 30/234
5,469,622 A * 11/1995 Gradoni ..... B26B 13/22 30/114
5,469,624 A * 11/1995 Brenton ..... B26B 13/24 30/232
5,526,571 A * 6/1996 Linden ..... B25B 7/06 30/255
5,722,171 A * 3/1998 Schmidt ..... F16C 11/10 30/255
5,781,999 A * 7/1998 Chang ..... B26B 13/20 30/232
5,943,779 A * 8/1999 Antonio, Jr. ..... B26B 13/00 30/248
6,079,107 A * 6/2000 Horvath ..... B26B 13/24 30/233.5
6,131,291 A * 10/2000 Mock ..... B26B 13/28 30/266
6,212,780 B1 * 4/2001 Huang ..... B26B 13/20 30/232
6,249,977 B1 * 6/2001 Knoop ..... B26B 13/24 30/232
6,915,578 B2 * 7/2005 Yusufov ..... B26B 13/00 30/232
7,424,778 B2 * 9/2008 Brenton ..... B26B 13/20 30/266
7,966,733 B2 * 6/2011 Jun ..... B26B 13/20 30/232
8,176,638 B2 * 5/2012 Hann ..... B26B 13/12 30/194
9,421,690 B2 * 8/2016 Soucie ..... B26B 13/20
2005/0005456 A1 * 1/2005 Wang ..... B26B 13/12 30/232
2005/0257378 A1 * 11/2005 Adachi ..... B26B 13/20 30/194
2006/0010695 A1 * 1/2006 Wu ..... B26B 13/20 30/232
2006/0064879 A1 * 3/2006 Lauritzen ..... B26B 13/20 30/232
2006/0143930 A1 * 7/2006 Adachi ..... B26B 13/12 30/232
2007/0209213 A1 * 9/2007 Chorpash ..... B26B 11/005 30/231
2010/0242289 A1 * 9/2010 Roskam ..... B26B 13/20 30/232
2012/0079724 A1 * 4/2012 Huang ..... B26B 13/20 30/232

FOREIGN PATENT DOCUMENTS

JP 3032395 U 10/1996
JP H09-504722 A 5/1997
JP 3106233 U 10/2004
JP 2007-252935 A 10/2007
JP 3174874 U 3/2012
JP 4889701 B2 3/2012
JP 2012-110467 A 6/2012

* cited by examiner

HAIRSTYLING SCISSORS

BACKGROUND OF THE INVENTION

1. Field of the Invention

The present invention relates to hairstyling scissors used when cutting hair.

2. Description of the Related Art

Various types of hairstyling (or hairdressing) scissors have been introduced in the past.

For example, hairstyling scissors disclosed in Japanese Patent No. 4889701, Japanese Laid-Open Patent Publication H5-1463 (1993), and Japanese Utility Model Registration No. 3032395 are known.

Meanwhile, the hairstyling profession has responded to ever changing fashion trends by creating a variety of hairstyles. In addition, the range of requested hairstyles is extensive due to diversity in individual taste. In response, vigorous quest for improvements in haircutting technology (and technique) has developed. Further, finished-product hairstyles have been presented in fashion-show manner, and haircutting technique itself has been displayed as an art-form.

Novel haircutting techniques have been shown in open forum. For example, standard scissor-holding methods have been altered to rapidly open and close the scissor blades and increase cutting speed. Cutting has been performed while changing scissor blade cutting angles (in a variety of orientations) with respect to the hair.

Attention has focused-in on cutting hair when it is dry, and since hair can easily be damaged when dry-cutting, there is need for techniques that withdraw the scissors while cutting, namely (scissor-withdrawing) "slide-cutting."

However, when (scissor-withdrawing) slide-cutting is performed, it is necessary for the hairstylist to continually withdraw (slide) the scissors while cutting. Consequently, this imposes a large burden on the scissor hand of the hairstylist.

The present invention was developed considering this problem. Thus, it is an object of the present invention to provide hairstyling scissors that can reduce the burden on the hairstylist during slide-cutting where the scissors are withdrawn from the hair.

SUMMARY OF THE INVENTION

To resolve the problem described above, the hairstyling scissors of the present invention are provided with a first scissor piece, a second scissor piece, and a pivot axis that connects the first scissor piece and the second scissor piece in a manner allowing those pieces to rotate mutually in an unimpeded fashion. By introducing hair between the first and second scissor pieces of the hairstyling scissors, haircutting is possible. The first scissor piece is a long narrow piece provided with a first blade section positioned ahead of the pivot axis, and a first handle section, which has a first finger eyelet (ring), and is positioned on the gripping-side of the pivot axis. The first handle section is bent back beyond the pivot axis towards the first blade section. The second scissor piece is a long narrow piece provided with a second blade section positioned ahead of the pivot axis, and a second handle section, which has a second finger eyelet, and is positioned on the gripping-side of the pivot axis. The second finger eyelet is bent back beyond the pivot axis towards the second blade section.

In addition, the hairstyling scissors of the present invention can be provided with a first scissor piece, a second scissor piece, and a pivot axis that connects the first scissor piece and the second scissor piece in a manner allowing those pieces to rotate mutually in an unimpeded fashion. Hair can be cut by introducing it between the first and second scissor pieces of the hairstyling scissors. The first scissor piece can be a long narrow piece provided with a first blade section positioned ahead of the pivot axis, and a first handle section, which has a first finger eyelet, and is positioned on the gripping-side of the pivot axis. The second scissor piece can be a long narrow piece provided with a second blade section positioned ahead of the pivot axis, and a second handle section, which has a second finger eyelet, and is positioned on the gripping-side of the pivot axis. The hairstyling scissors can also be provided with a tilt angle adjustment section to control the (longitudinal) blade angle between the first and second blade sections.

Since scissor closing action for the hairstyling scissors of the present invention moves the pivot axis in a direction away from the hair, the burden on the hairstylist can be dramatically reduced during slide-cutting where the scissors are withdrawn from the hair. The above and further objects of the present invention as well as the features thereof will become more apparent from the following detailed description to be made in conjunction with the accompanying drawings.

DETAILED DESCRIPTION OF THE EMBODIMENTS

The following describes embodiments of the present invention based on the figures. However, the following embodiments are merely specific examples of hairstyling scissors representative of the technology associated with the present invention, and the hairstyling scissors of the present invention are not limited to the embodiments described below. Further, to make the scope of the claims easy to understand, reference numbers (signs) are assigned to embodiment components. However, components described in the claims are in no way limited to the components of the embodiments. Particularly, in the absence of specific annotation, structural component features described in the embodiments such as dimensions, raw material, shape, and relative position are simply for the purpose of explicative example and are not intended to limit the scope of the invention. Properties such as the size and spatial relation of components shown in the figures may be exaggerated for the purpose of clear explanation. In the descriptions following, components with the same name and reference number (sign) indicate components that are the same or have the same properties and their detailed description is appropriately abbreviated. Further, a single component can serve multiple functions and a plurality of structural elements of the invention can be implemented with the same component. In contrast, the functions of a single component can be separated and implemented by a plurality of components. In addition, explanations used to describe part of one implementation mode or embodiment may be used in other implementation modes or embodiments.

First Embodiment

Figure 1:
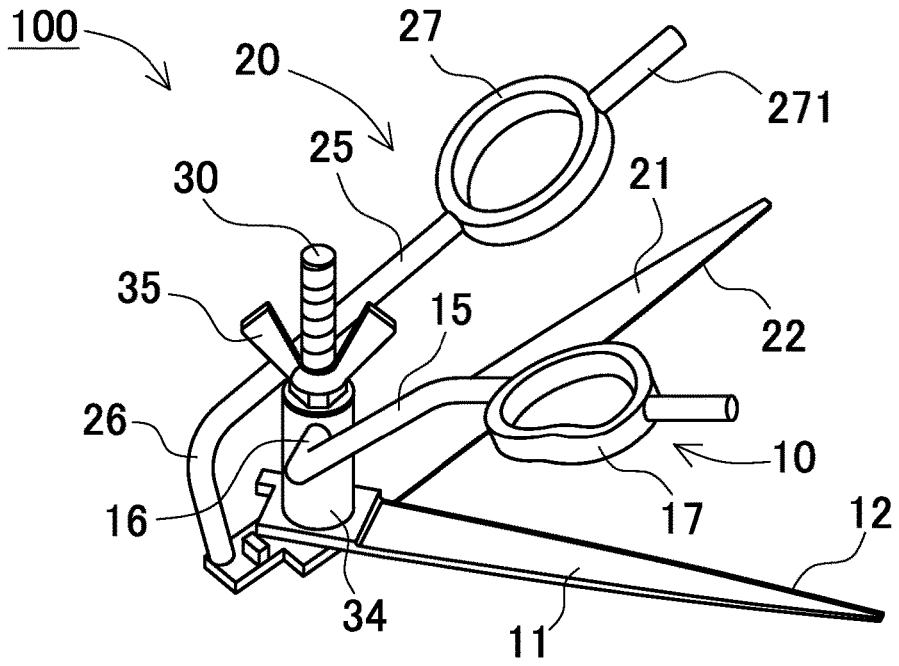
FIG. 1 is an oblique view of hairstyling scissors for the first embodiment with the blades open.
Figure 2:
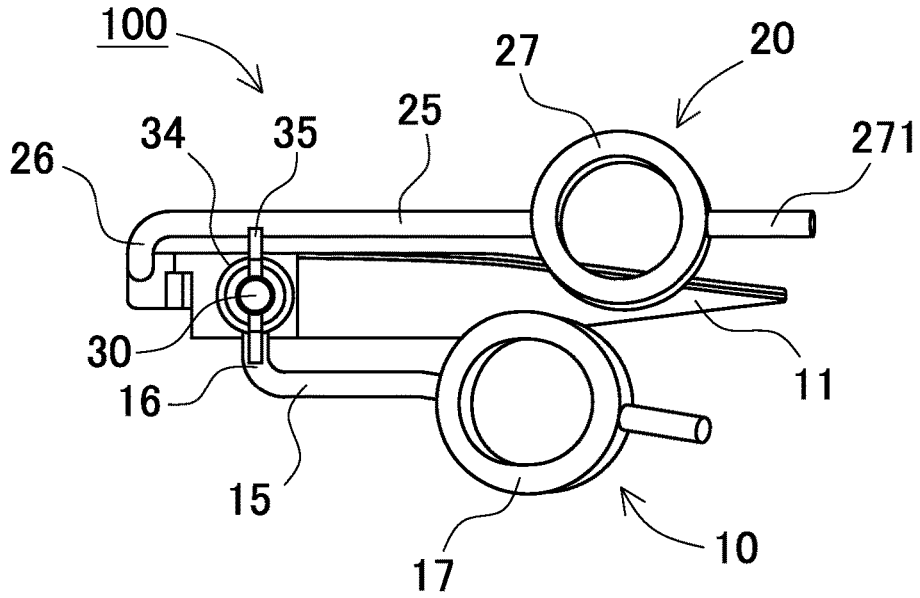
FIG. 2 is a plan view of hairstyling scissors for the first embodiment with the blades closed.
Figure 3:
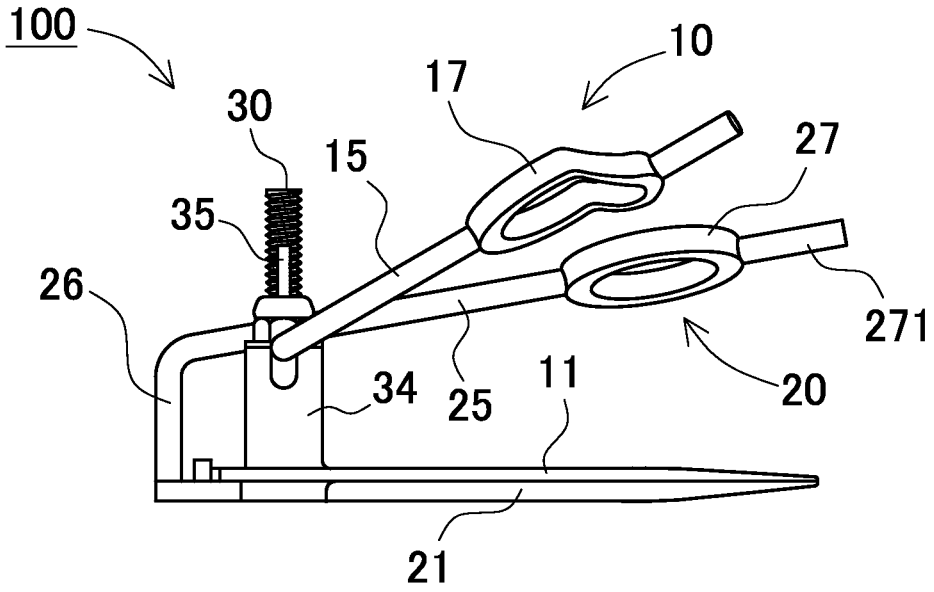
FIG. 3 is a front view of hairstyling scissors for the first embodiment with the blades closed.

The following describes hairstyling scissors 100 for the first embodiment of the present invention with reference to the figures. FIG. 1 is an oblique view of hairstyling scissors 100 for the first embodiment with the blades open. FIG. 2 is a plan view of hairstyling scissors 100 for the first embodiment with the blades closed. FIG. 3 is a front view of hairstyling scissors 100 for the first embodiment with the blades closed.

Figure 4:
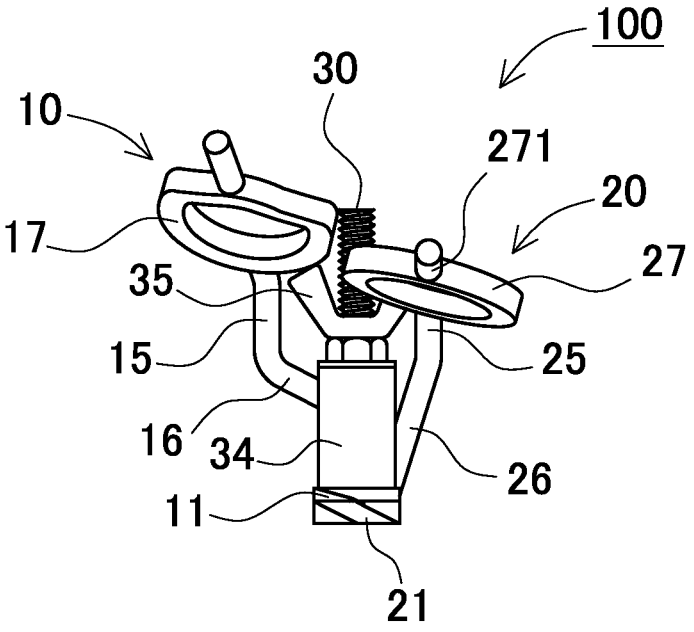
FIG. 4 is a right side view of hairstyling scissors for the first embodiment with the blades closed.
Figure 5:
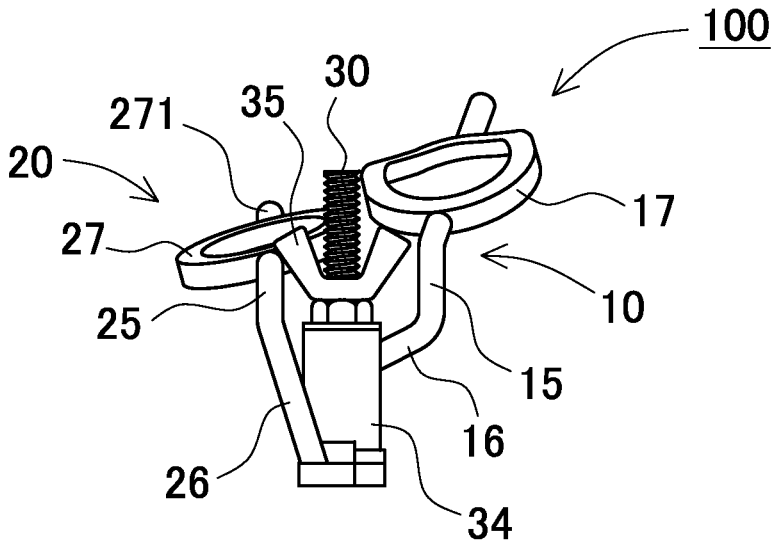
FIG. 5 is a left side view of hairstyling scissors for the first embodiment with the blades closed.
Figure 6:
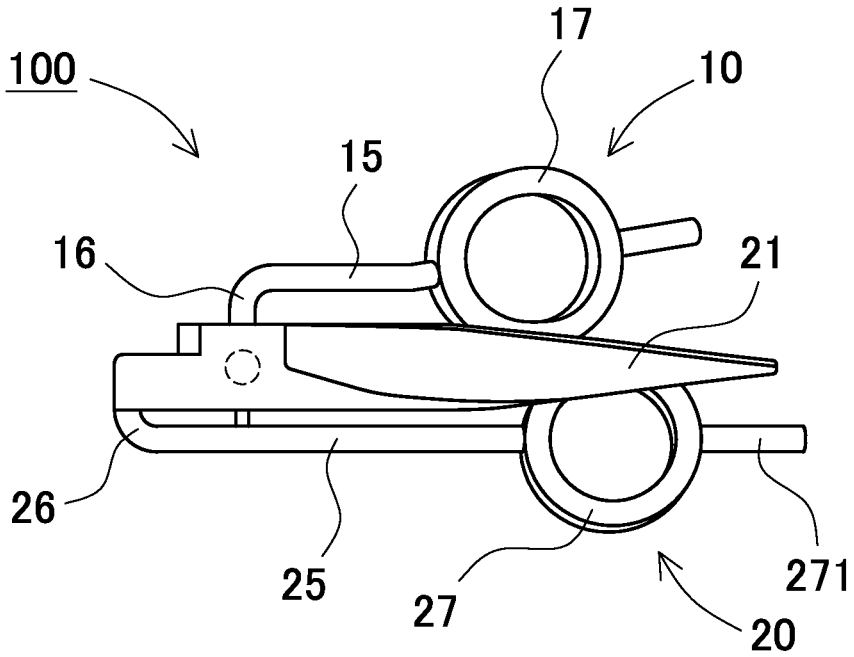
FIG. 6 is a bottom view of hairstyling scissors for the first embodiment with the blades closed.
Figure 7:
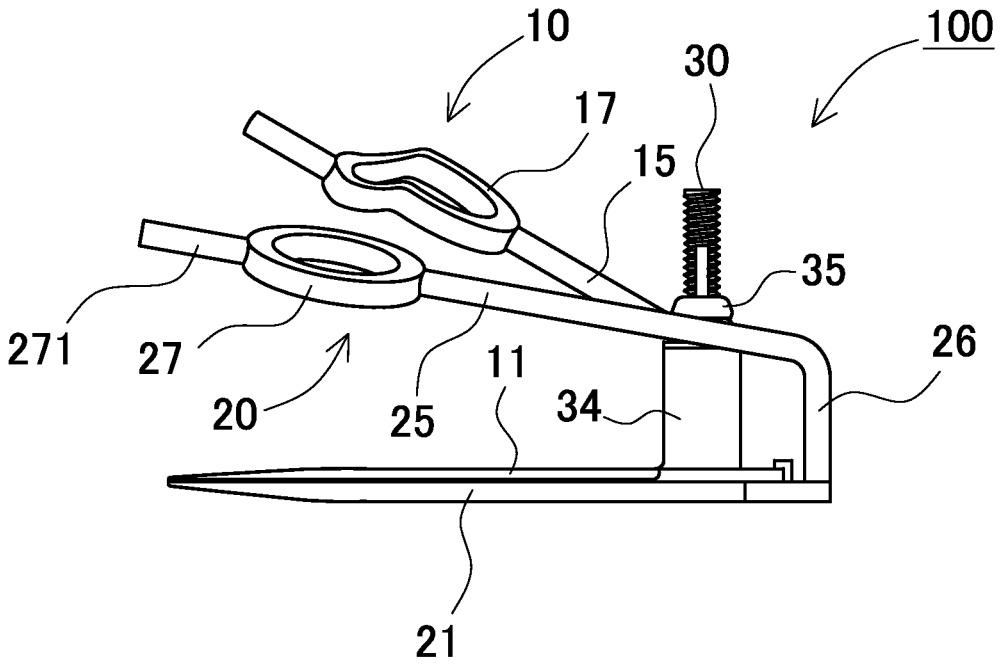
FIG. 7 is a rear view of hairstyling scissors for the first embodiment with the blades closed.
Figure 13:
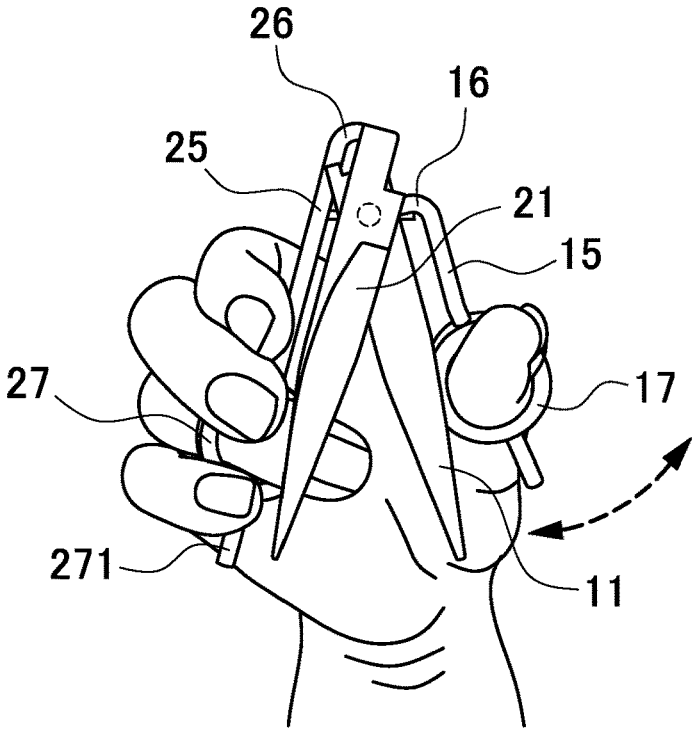
FIG. 13 is a drawing showing operation of hairstyling scissors for the first embodiment.

FIG. 4 is a right side view of hairstyling scissors 100 for the first embodiment with the blades closed. FIG. 5 is a left side view of hairstyling scissors 100 for the first embodiment with the blades closed. FIG. 6 is a bottom view of hairstyling scissors 100 for the first embodiment with the blades closed. FIG. 7 is a rear view of hairstyling scissors 100 for the first embodiment with the blades closed. Finally, FIG. 13 is a drawing showing operation of hairstyling scissors 100 for the first embodiment.

The hairstyling scissors 100 for the first embodiment are provided with a first scissor piece 10, which acts as the action blade, a second scissor piece 20, which acts as the stationary blade, and a pivot axis 30, which acts as the pivot point supporting unimpeded rotation of the first scissor piece 10 and the second scissor piece 20 where they cross in an x-pattern.

The first scissor piece 10 is a long narrow piece formed with a flat-plate shaped part and a pivot axis opening approximately in the midsection where the pivot axis 30 inserts. The first scissor piece 10 has a first blade section 11 formed on the blade-side of the pivot axis opening with a blade edge 12, which establishes the length of the blade, disposed on the inner edge. The first scissor piece 10 also has a hollow cylindrical section, and the hollow part of the cylindrical section is continuous with the pivot axis opening.

The first scissor piece 10 has a first handle section 15 on the gripping-side of the pivot axis opening, and that part is held by the hairstylist when using the hairstyling scissors 100. The first handle section 15 is provided with a first arm 16 formed with a narrower shape than the first blade section 11 on the gripping-side of the pivot axis opening, and a first finger eyelet 17 formed at the gripping-end of the first arm 16 for finger insertion (normally the hairstylist's thumb).

In this embodiment, when viewed from the front (refer to FIG. 3), the first arm 16 of the first scissor piece 10 bends through a 180° angle in a u-shape. Further, when viewed from above as shown in FIG. 2, the first arm 16 is bent to make the first handle section 15 and the first blade section 11 extend in approximately parallel directions.

For prior-art scissors, the action blade and stationary blade extend horizontally and cross at the pivot axis. When viewed from above in a plan view, the relative positions of the blade sections and handle sections of the action blade and stationary blade swap position on either side of the pivot axis. In contrast, the first scissor piece 10 and second scissor piece 20 of the present embodiment bend in u-shapes around the pivot axis 30. Accordingly, the first handle section 15 and first blade section 11, which traverse the pivot axis 30, are both disposed on the same lower side of a plan view (refer to the plan view of FIG. 2), and the second handle section 25 and second blade section 21, which traverse the pivot axis 30, are both disposed on the same upper side of the plan view.

The second scissor piece 20 has a structure similar to that of the first scissor piece 10 with a pivot axis opening 24 formed approximately in the midsection. The second scissor piece 20 is provided with a second blade section 21 formed on the blade-side of the pivot axis opening 24 with a blade edge 22 disposed on the inner edge, and a second handle section 25 formed on the gripping-side of the pivot axis opening 24 that has a second arm 26 and a second finger eyelet 27.

Normally, the hairstylist's ring finger inserts into the second finger eyelet 27. A finger-rest 271 is formed outside the second finger eyelet 27 to support the little finger during scissor use. The second arm 26 of the second scissor piece 20 bends through a 180° angle in the same manner as the first arm 16 of the first scissor piece 10 and the second scissor piece 20 also has a u-shape when viewed from the front (refer to FIG. 3).

The pivot axis 30 that passes through the pivot axis opening in the first scissor piece 10 and the pivot axis opening 24 in the second scissor piece 20 is a screw (or bolt) that can be tension adjusted. The first and second scissor pieces 10, 20 are not fixed to the pivot axis 30, but rather can rotate freely. In this example, the end of the pivot axis is attached at the second scissor piece 20 pivot axis opening 24. Further, in this example, the pivot axis is a threaded bolt with a wing-nut 35 that screws on the upper end and applies pressure to the cylindrical section. Tightening the wing-nut 35 increases pressure on the cylindrical section, and this allows tightness adjustment between the first scissor piece, which is fixed to the cylindrical section, and the second scissor piece, which is fixed to the pivot axis.

If a gap develops between blade edges in the cutting sections of the first and second scissor pieces, that gap makes it difficult to cut hair introduced between the blades. To avoid this condition, a structure can be provided that forces the first and second scissor pieces together (towards contact). For example, the pivot axis can have a spring that intervenes between the nut and the cylindrical section to force the first scissor piece towards the second scissor piece.

Figure 14:
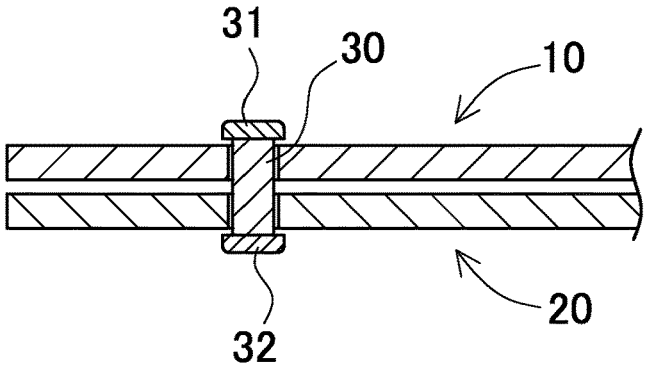
FIG. 14 is a cross-section view showing the pivot axis for an alternate example.

Alternatively, pivot axis structure can be simplified by not providing any tension adjustment mechanism, but rather by simply connecting the scissor pieces in a manner that allows unimpeded rotation. This type of structure is shown as an alternate example in FIG. 14. In this example, a wider swaged region 31 is formed on the upper end of the pivot axis 30 and another wider swaged region 32 is formed on the lower end below the first scissor piece 10 and second scissor piece 20, which are held in the middle of the pivot axis 30 in a manner that allows free rotation. This structure has the positive feature that manufacturing cost can be reduced due to pivot axis 30 simplification.

The preceding describes the structure of the hairstyling scissors 100. When the hairstyling scissors 100 are used by someone such as a hairstylist, the user's thumb is inserted in the first finger eyelet 17 of the first scissor piece 10, the user's ring finger is inserted in the second finger eyelet 27 of the second scissor piece 20, and the user's little finger is placed on the finger-rest 271.

With the second scissor piece 20, which is the stationary blade, held by the ring finger and little finger, and the first scissor piece 10, which is the action blade, held by the thumb, the scissors are opened and closed. Opening and closing the scissors moves the crossing point of the blade edge 12 of the first blade section 11 and the blade edge 22 of the second blade section 21. Hair introduced between the first blade section 11 and the second blade section 21 is cut in the region where the blade edges cross. Namely, the location where hair is cut is the crossing point of the blade edges 12, 22.

Figure 8:
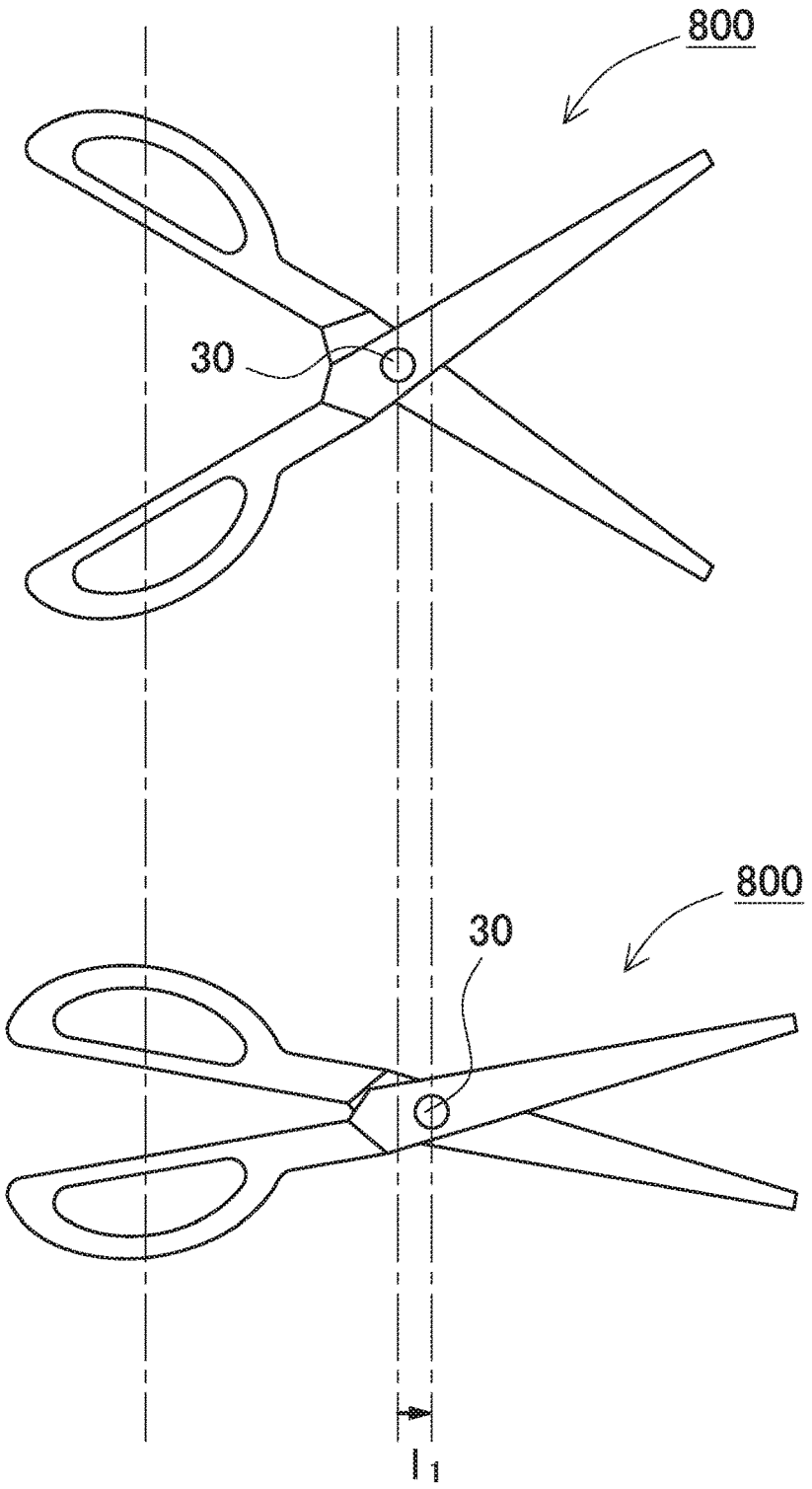
FIG. 8 PRIOR ART
FIG. 8 is a schematic drawing as viewed from above illustrating prior-art scissor operation during hair cutting.
Figure 9:
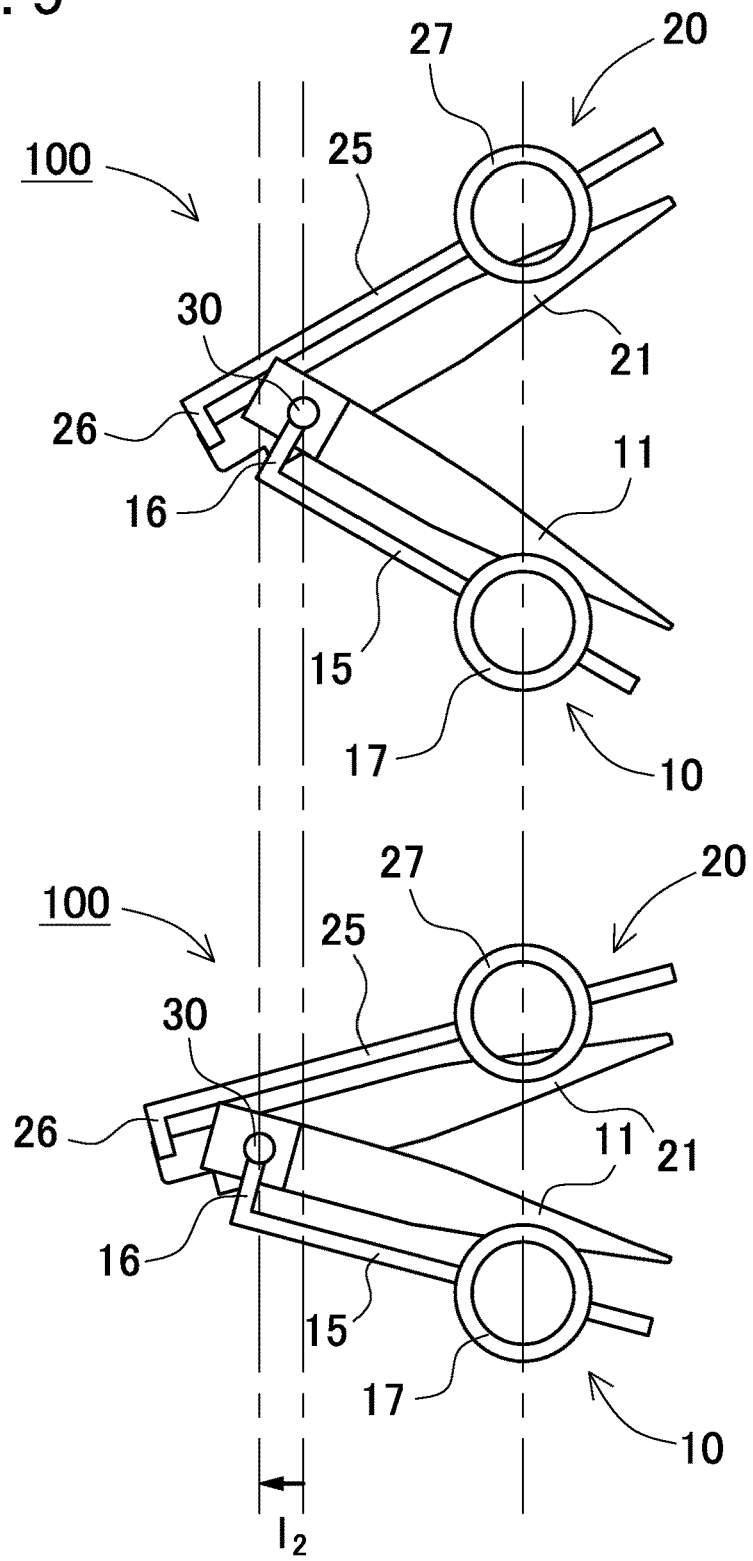
FIG. 9 is a schematic drawing as viewed from above illustrating scissor operation during hair cutting with hairstyling scissors for the first embodiment.

Next, scissor operation during haircutting using hairstyling scissors is described with reference to FIGS. 8 and 9. FIG. 8 is a schematic drawing as viewed from above illustrating prior-art scissor 800 operation during hair cutting. FIG. 9 is a schematic drawing as viewed from above illustrating scissor operation during hair cutting with hairstyling scissors 100 for the first embodiment.

The prior-art hairstyling scissors 800 shown in FIG. 8 are configured with an action blade and a stationary blade that both extend in straight lines and cross in an x-pattern at the pivot axis 30 where they are connected in a manner allowing free rotation. FIG. 8 shows schematically abbreviated hairstyling scissors 800 with the blades open in the upper diagram and with the blades partially closed in the lower diagram. Here, the lateral position of the finger eyelets (shown by the left-most vertical broken line) is the same in both the upper and lower diagrams.

Since the distance from the finger eyelets to the pivot axis 30 (the length of the handle sections) is constant, partially closing the blades moves the pivot axis 30 (by a distance $l_1$) to the right of its location when the blades are open. Specifically, for prior-art hairstyling scissors 800, the distance from the user's hand, which holds the finger eyelets, to the pivot axis increases as the scissors are closed (i.e. the blade-opening angle decreased), this withdraws the pivot axis from the user in a direction towards the tips of the blades.

In addition, as the blades are closed and the blade-opening angle decreased, the crossing point of the action and stationary blade edges, which is the haircutting location, also moves towards the tips of the blades. Accordingly, the haircutting location in prior-art hairstyling scissors 800 moves significantly towards the blade tips as the scissor blades are closed, and this means that the cutting location is pushed into the hair during haircutting.

Pushing the scissor cutting point into the hair pushes hair into the blades making it easy for the blades to become jammed with hair. If the hairstyling scissors physically become jammed with hair, the hair can be damaged and haircutting must be temporarily halted. Clearing the jammed hair and resuming haircutting consumes significant time, and for the person receiving the haircut the experience is not pleasant. Further, using prior-art hairstyling scissors to perform slide-cutting where the scissors are withdrawn from the hair during cutting, the hairstylist is required to move the scissor-holding hand with large withdrawing motions while cutting.

In contrast, the hairstyling scissors 100 for the first embodiment are shown in FIG. 9. The upper diagram of FIG. 9 shows the hairstyling scissors 100 with the blades open, and the lower diagram shows the blades partially closed. Here, the lateral position of the finger eyelets (shown by the right-most vertical broken line) is the same in both the upper and lower diagrams. As shown in FIG. 9, partially closing the blades moves the pivot axis 30 (by a distance $l_2$) to the left of its location when the blades are open. Specifically, as the blades of the hairstyling scissors 100 of the first embodiment are closed, the pivot axis 30 moves in a direction away from the user's hand and also moves in a direction away from the tips of the blades.

The crossing point of the blade edges 12, 22 of the first and second scissor pieces 10, 20 of the hairstyling scissors 100 described above moves towards the hair as the scissors are closed and the blade-opening angle decreased. However, since the pivot axis 30 moves in a direction away from the hair as the hairstyling scissors 10 are closed, movement of the blade edge 12, 22 crossing point towards the hair is restrained or cancelled by the opposing pivot axis 30 movement.

Since the finger eyelets 17, 27 of the hairstyling scissors 100 are on the same side of the pivot axis 30 as the blade sections 11, 21, movement of the haircutting location (blade edge crossing point) towards the hair during scissor closing can be significantly restrained compared to that for prior-art hairstyling scissors 800. Or, movement of the haircutting location during scissor 100 closing may be away from the hair.

Consequently, pushing the blades towards the hair during cutting, which occurs naturally when prior-art hairstyling scissors 800 are opened and closed, can be significantly curtailed by the hairstyling scissors 100 of the present embodiment. This can prevent hair from becoming jammed in the scissors during cutting, and can minimize hair damage during dry-cutting. Further, with the hairstyling scissors 100 of the present embodiment, the burden on the hairstylist when the scissors are withdrawn from the hair during slide-cutting can be reduced making it possible to easily perform scissor-withdrawing slide-cutting.

The first embodiment of the present invention is described above. However, various changes can be made to the present embodiment as long as those changes remain within the bounds of the primary intent of the present invention. For example, the size, shape, and (raw) materials of the various components that make up the hairstyling scissors 100 can be changed as appropriate. In addition, although the first and second scissor pieces 10, 20 of the first embodiment bend in u-shapes through 180° angles, the angle of bending and the curve shape can also be changed as appropriate.

Second Embodiment

Figure 10:
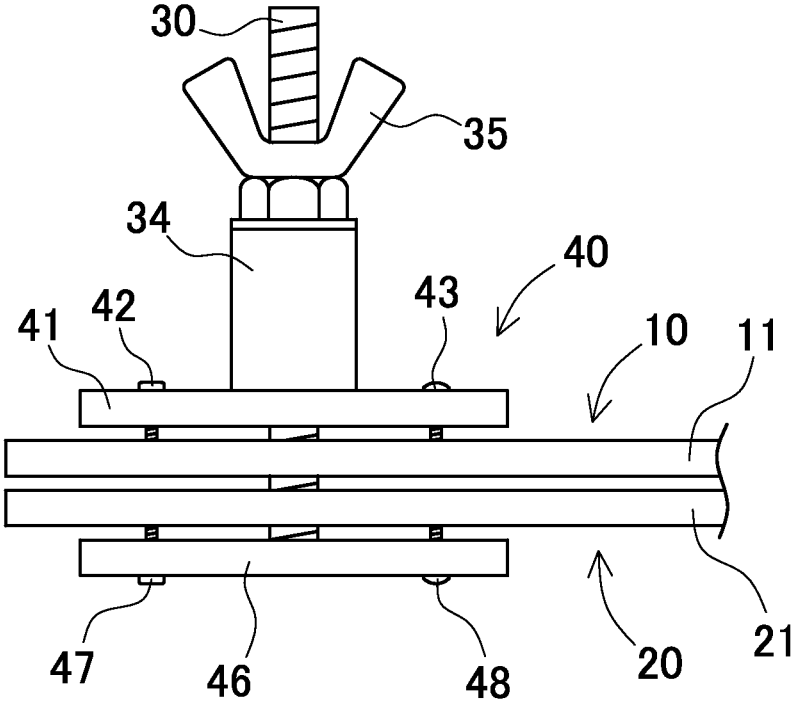
FIG. 10 is an enlarged front view of the tilt angle adjustment section for the second embodiment.
Figure 11:
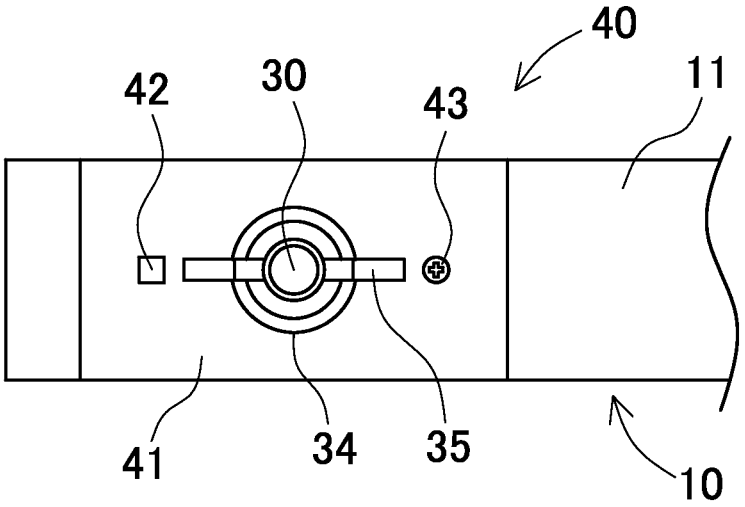
FIG. 11 is an enlarged plan view of the tilt angle adjustment section for the second embodiment.
Figure 15:
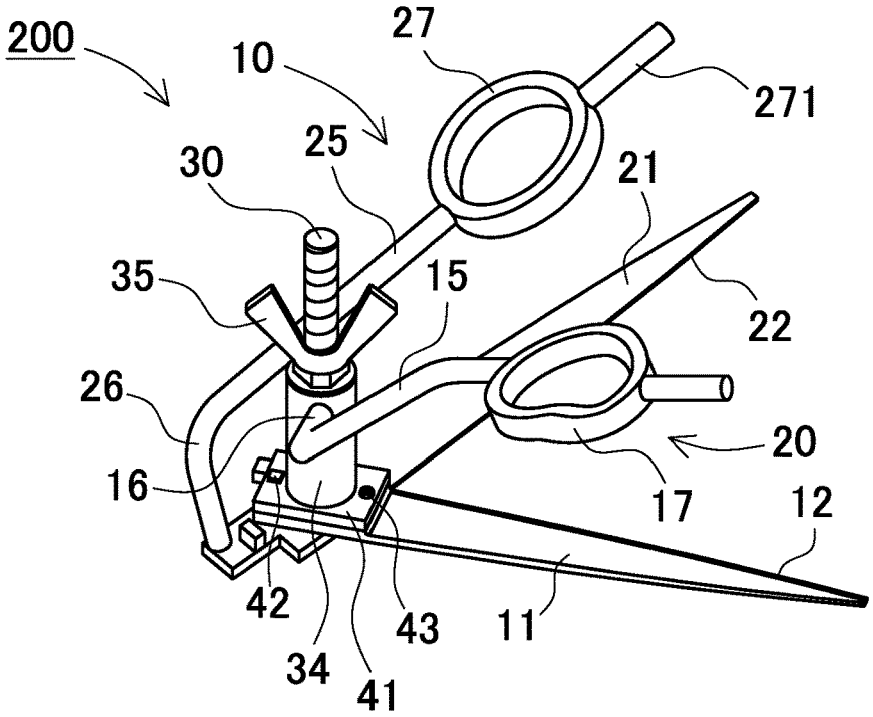
FIG. 15 is an oblique view of hairstyling scissors for the second embodiment.

A tilt angle adjustment section centered at the pivot axis can be added to adjust the angle between the first blade section and the second blade section. Hairstyling scissors that include a tilt angle adjustment section are described below as the second embodiment and are shown in FIGS. 15, 10, 11, and 12. FIG. 15 is an oblique view of hairstyling scissors 200 for the second embodiment; FIG. 10 is an enlarged front view showing the tilt angle adjustment section of the hairstyling scissors 200 for the second embodiment; and FIG. 11 is an enlarged plan view showing the tilt angle adjustment section of the hairstyling scissors 200 for the second embodiment. Note in FIG. 10 that gaps between components are shown wider than actuality to make tilt angle adjustment section structure easy to visualize.

The hairstyling scissors 200 for the second embodiment are provided with a tilt angle adjustment section 40 for fine adjustment of the angle of engagement between the first blade section 11 of the first scissor piece 10 and the second blade section 21 of the second scissor piece 20. Other than the tilt angle adjustment section 40, the structure of the hairstyling scissors 200 for the second embodiment is the same as that of the hairstyling scissors 100 for the first embodiment. Accordingly, components common to both embodiments have the same reference number (sign), and their description is abbreviated.

The first scissor piece 10 and second scissor piece 20 of the hairstyling scissors normally extend in approximately horizontal directions, and the first blade section 11 and the second blade section 21 engage in approximately horizontal disposition. However, to finely adjust cutting performance, it is necessary to finely adjust the (longitudinal) angle (of inclination) between the first blade section 11 and the second blade section 21. To adjust the angle between the first blade section 11 and the second blade section 21, the (longitudinal) tilt angle of one of the blade sections is adjusted with respect to the other blade section.

As shown in FIGS. 10 and 11, the tilt angle adjustment section 40 is established in the region around the pivot axis 30 and is provided with a first tilting plate 41, a first adjustment screw 43, a second tilting plate 46, and a second adjustment screw 48. The first tilting plate 41 is disposed adjacent to the top of the first scissor piece 10, and the second tilting plate 46 is disposed adjacent to the bottom of the second scissor piece 20.

In order from the top down, the first tilting plate 41, the first scissor piece 10, the second scissor piece 20, and the second tilting plate 46 are stacked on the pivot axis 30 and held in close contact by the pivot axis 30. The first tilting plate 41, the first scissor piece 10, the second scissor piece 20, and the second tilting plate 46 are all free to rotate about the pivot axis 30.

In the example of FIG. 10, the bottom end of the pivot axis 30 is fixed to the second tilting plate 46. In addition, a hollow cylindrical section is fixed to the top of the first tilting plate 41 and the hollow part of the cylindrical section extends in a manner continuous with the pivot axis opening in the first tilting plate 41. Further, pressure is applied to the upper end of the cylindrical section by a wing-nut 35 that is threaded onto the pivot axis above the cylindrical section.

The first tilting plate 41 and the first adjustment screw 43 are components that serve to control the (longitudinal) tilt angle of the first blade section 11, which normally extends in an approximately horizontal direction. The first tilting plate 41 is a short flat-plate piece with approximately the same lateral width as the first scissor piece 10. The first tilting plate 41 is stacked on top of the first scissor piece 10 and disposed in the region around the pivot axis 30.

The first tilting plate 41 has a pivot axis opening for insertion of the pivot axis 30, and has a screw-hole to accommodate the first adjustment screw 43, which screws into (and through) the first tilting plate 41 on the blade-side of the pivot axis (the right side in FIGS. 10 and 11).

In addition, the first tilting plate 41 is provided with a first attachment point 42 to attach the first tilting plate 41 to the first scissor piece 10 on the gripping-side of the pivot axis opening. The first scissor piece 10 and the first tilting plate 41 are joined together as a unit via the first attachment point 42, and those components rotate as a unit about the pivot axis 30.

The first adjustment screw 43 screws through the screw-hole formed on the blade-side of the pivot axis 30, and the tip of the screw is capable of extending out from the bottom surface of the first tilting plate 41. The amount that the first adjustment screw 43 extends out from the bottom of the first tilting plate 41 can be controlled by screw rotation. As the first adjustment screw 43 is screwed in and extends out from the bottom of the first tilting plate 41 on the blade-side of the pivot axis 30, its tip contacts the upper surface of the first blade section 11. When the first adjustment screw 43 is screwed in further, it acts in a manner to force separation between the first tilting plate 41 and the first blade section 11.

At the same time, upward movement of the top of the first tilting plate 41 is prevented by the wing-nut, and downward movement of the pivot axis region of the first scissor piece 10 is prevented by the second scissor piece 20, the second tilting plate 46 and attachment of the end of the pivot axis 30 at the bottom.

As a result, the first blade section 11 of the first scissor piece 10, which is pressed upon by the tip of the first adjustment screw 43, moves by a small amount to tilt the blade-end downward from horizontal. Accordingly, by adjusting the amount that the first adjustment screw 43 is screwed into the first tilting plate 41, the (longitudinal) inclination angle of the first blade section 11 can be finely adjusted. Namely, the tilt angle (in the lengthwise direction) of the first blade section 11 can be finely adjusted by screwing the first adjustment screw 43.

The second tilting plate 46 and the second adjustment screw 48 are components that serve to control the (longitudinal) tilt angle of the second blade section 21, which normally extends in an approximately horizontal direction. Except for being inverted, the structure and operation of the second tilting plate 46 and second adjustment screw 48 are the same as that for the previously described first tilting plate 41 and first adjustment screw 43 and further description is abbreviated. Specifically, by adjusting the amount that the second adjustment screw 48 is screwed into the second tilting plate 46, the (longitudinal) inclination angle of the second blade section 21 of the second scissor piece 20 can be finely adjusted. Namely, the tilt angle (in the lengthwise direction) of the second blade section 21 can be finely adjusted by screwing the second adjustment screw 48.

Further, in the same manner as the first tilting plate 41, the second tilting plate 46 is provided with a second attachment point 47 to attach the second tilting plate 46 to the second scissor piece 20 on the gripping-side of the pivot axis opening. Since the second scissor piece 20 and the second tilting plate 46 are joined together as a unit via the second attachment point 47, those two pieces rotate as a unit about the pivot axis 30.

The preceding describes hairstyling scissors 200 for the second embodiment. In addition to the effective advantages achieved by the first embodiment (described previously), the second embodiment allows the (longitudinal) tilt angles of the first blade section 11 and the second blade section 21 to be independently adjusted. Fine adjustment of the angle between the first blade section 11 and the second blade section 21 controls blade engagement and allows hairstyling scissor cutting capabilities to be fine-tuned.

Figure 12:
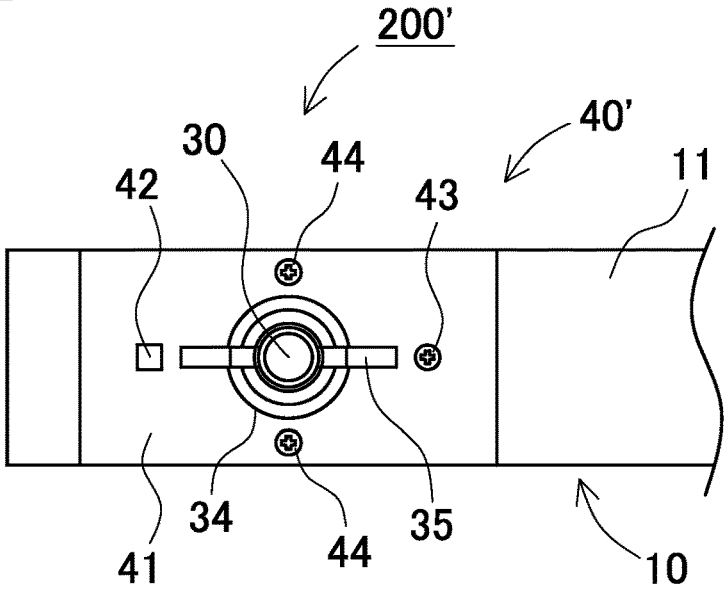
FIG. 12 is an enlarged plan view of the tilt angle adjustment section for the first alternate example of the second embodiment.

Next, a first alternate example of the hairstyling scissors of the second embodiment is described based on FIG. 12. FIG. 12 is an enlarged plan view of the tilt angle adjustment section of hairstyling scissors 200' for the first alternate example of the second embodiment.

In addition to adjusting the angles that the first and second blade sections 11, 21 tilt in the lengthwise direction, the hairstyling scissors 200' of the first alternate example can adjust the angle of rotation of the first and second blade sections 11, 21 about an axis aligned with the lengthwise (longitudinal) direction. Namely, the amount of blade twist between the first blade section 11 and the second blade section 21 can be controlled. Note that blade tilt and blade twist are orthogonally related.

The basic structure of the hairstyling scissors 200' for the first alternate example is essentially the same as that of the hairstyling scissors 200 for the second embodiment (described above) except for a small difference in the tilt angle adjustment section. Accordingly, components that are the same have the same reference number (sign), and their description is abbreviated.

Figure 16:
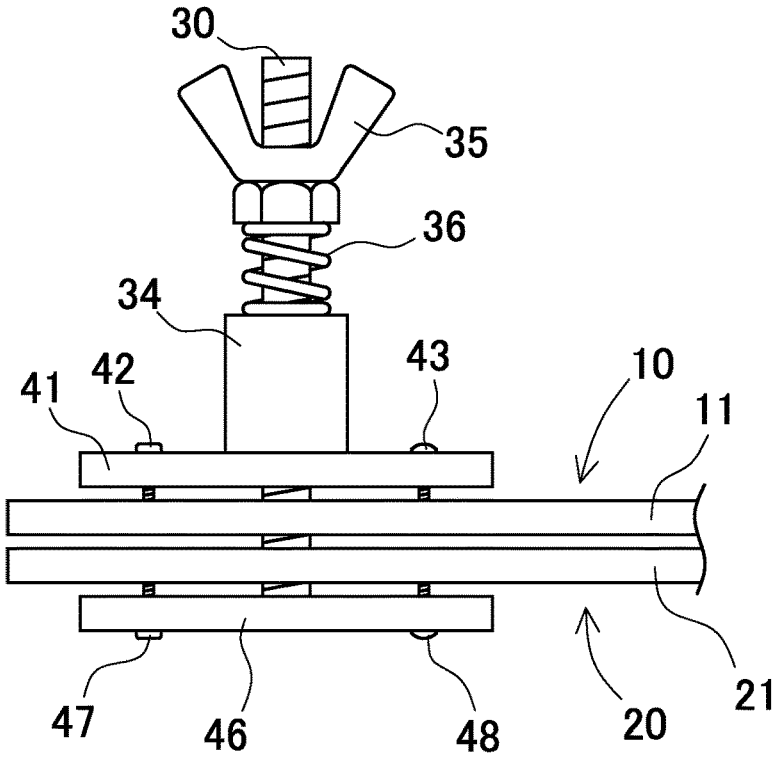
FIG. 16 is a front view showing the pivot axis for an alternate example.

As shown in FIG. 12, the tilt angle adjustment section 40' of the first alternate example is provided with a first tilting plate 41, a first adjustment screw 43, third adjustment screws 44, a second tilting plate, a second adjustment screw, and fourth adjustment screws. Note that the second tilting plate, second adjustment screw, and fourth adjustment screws are positioned on the backside (and not shown) in FIG. 12. Of those non-visible components, the second tilting plate and the second adjustment screw have essentially the same configuration as the second tilting plate 46 and the second adjustment screw 48 shown in FIGS. 10 and 16 (described later).

The third adjustment screws 44 are two screws disposed on either side of the pivot axis 30 in the width (lateral) direction of the first tilting plate 41. The third adjustment screws 44 screw into (and through) screw-holes in the first tilting plate 41 in the same manner as the first adjustment screw 43 and are capable of extending out from the bottom surface of the first tilting plate 41. Accordingly, by adjusting the amount that the two third adjustment screws 44 are screwed into the first tilting plate 41, the amount of twist (around the longitudinal axis) of the first blade section 11 can be finely controlled.

Similarly, the fourth adjustment screws are two screws disposed on either side of the pivot axis 30 in the width (lateral) direction of the second tilting plate in the same configuration as the third adjustment screws 44 and the first tilting plate 41 except that they are on the reverse side (backside in FIG. 12). The fourth adjustment screws also screw into (and through) screw-holes in second tilting plate in the same manner that the first adjustment screw 43 screws into the first tilting plate 41. The fourth adjustment screws are capable of extending out from the upper surface of the second tilting plate. By adjusting the amount that the two fourth adjustment screws are screwed into the second tilting plate, the amount of twist (around the longitudinal axis) of the second blade section 21 can be finely controlled.

In this manner, the first alternate example not only enables fine adjustment of the longitudinal inclination of the first and second blade sections 11, 21, but also enables fine adjustment of the twist (around the longitudinal axis) of those blade sections. As a result, hairstyling scissor cutting performance can be fine-tuned to an even greater degree.

In the same manner as previously described for the first embodiment, the second embodiment can also include a structure that forces the first and second scissor pieces together (towards contact). Implementation of this type of structure is described as two alternate examples shown in FIGS. 16 and 17. In the example shown in FIG. 16, a spring 36 intervenes above the cylindrical section 34 between the wing-nut 35, which threads onto the pivot axis 30, and the upper end of the cylindrical section 34. In this example, the cylindrical section is attached to the first tilting plate 41 and the bottom end of the pivot axis 30 is fixed to the second tilting plate 46. Consequently, the first tilting plate 41 and the second tilting plate 46 are squeezed together by pressure applied by the spring 36 through the cylindrical section 34, and this acts to force greater contact between the first and second scissor pieces.

Figure 17:
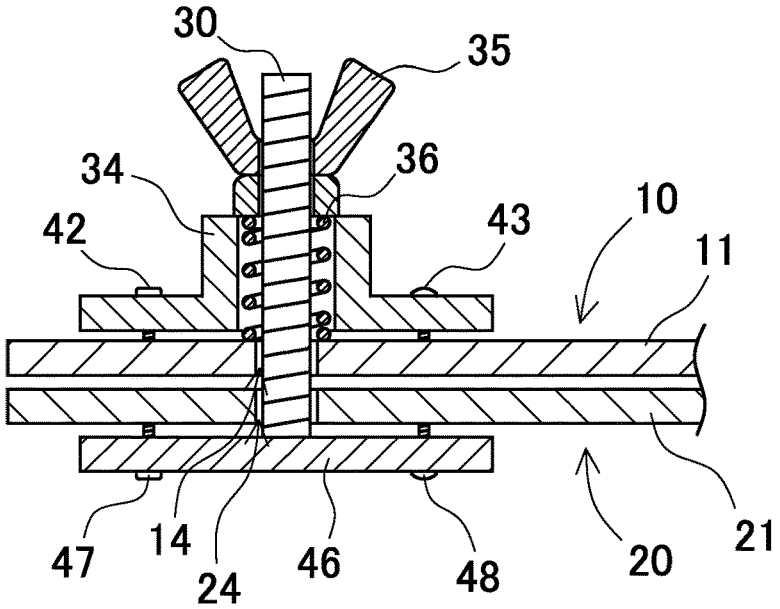
FIG. 17 is a cross-section view showing the pivot axis for another alternate example.

However, this is only one example and, as shown in FIG. 17, a configuration where the spring 36 is housed inside the cylindrical section is also possible. In this example, the inside diameter of the cylindrical section is made larger than the pivot axis openings 14, 24 in the first and second scissor pieces. In addition, the inside diameter of the spring 36 is also made larger than the first and second scissor piece pivot axis openings 14, 24, and the diameter of the spring 36 is made smaller than the inside diameter of the cylindrical section. This structure allows the end of the spring 36 to press on the first scissor piece around the pivot axis opening 14 forcing more contact between the first and second scissor pieces in the same manner as the example in FIG. 16.

In the present embodiment as well, various changes can be made as long as they are within the bounds of the primary intent of the present invention. For example, instead of providing tilt adjustment structures for both the first scissor piece 10 and the second scissor piece 20, a single adjustment structure can be established on just one of the scissor pieces.

Figure 18:
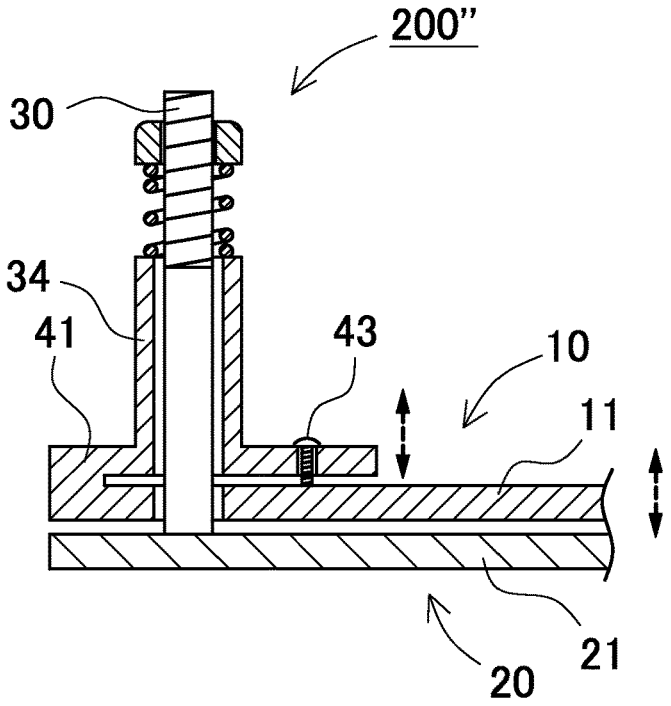
FIG. 18 is a cross-section view showing the pivot axis for another alternate example.

As shown in the alternate example hairstyling scissors 200" of FIG. 18, instead of providing the first tilting plate 41 with a first attachment point, the back end of the first tilting plate 41 can be connected to the first blade section 11 allowing adjustment of the blade inclination angle using only the first adjustment screw 43. In this example, when the first adjustment screw 43 is screwed in, the first blade section 11 is pressed downward to lower the blade tip. Conversely, when the first adjustment screw 43 is retracted, the blade tip is raised due to inherent stress that acts to keep the first blade section 11 and the first tilting plate 41 close together. Alternatively, both the first and second tilting plates can be omitted and the first adjustment screw can be directly threaded into a blade section, or the first and second blade sections can each be made as a single-piece unit having a built-in tilting plate. In addition, the pivot axis 30 can be made as a replaceable part to allow pivot axis replacement due to degradation over time. This can enable long-term use of the hairstyling scissors.

Still further, either the first finger eyelet, the second finger eyelet, or both finger eyelets can be detachable. For example, the first and second finger eyelets can be replaceable with eyelets sized to fit the user's fingers, or different materials can be used in first and second finger eyelets to improve scissor operation (e.g. rubber padding can be included in finger-insertion regions to reduce slipping). In particular, since the user's fingers are repeatedly inserted into and removed from the finger eyelets, there can be significant wear on those parts and making them replaceable can improve scissor utility.

In the present embodiment, a configuration that finely adjusts first and second blade section 11, 21 longitudinal inclination in a dedicated manner, and a configuration that finely adjusts first and second blade section 11, 21 longitudinal inclination as well as twist around the longitudinal axis were both described. Accordingly, a configuration that adjusts blade twist around the longitudinal axis in a dedicated manner is also possible. In this embodiment as well, properties such as the size, shape, and (raw) materials of the various components that make up the hairstyling scissors can be changed as appropriate. For example, although hairstyling scissors in the examples described above adopted right-hand scissor blades, the present invention is also applicable to hairstyling scissors with blades designed for left-hand scissors.

Third Embodiment

Figure 19:
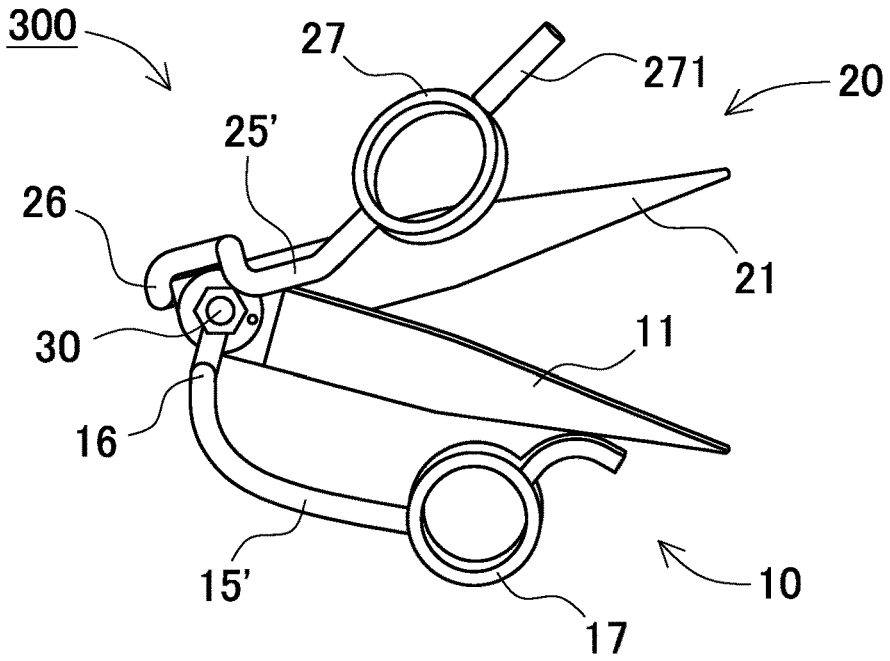
FIG. 19 is a plan view of hairstyling scissors for the third embodiment with the blades open.
Figure 20:
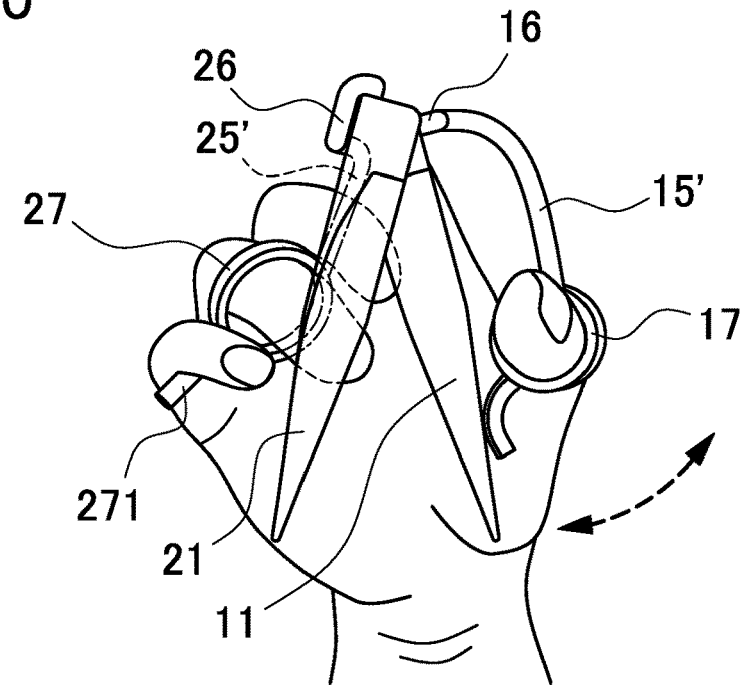
FIG. 20 is a drawing showing reverse-grip operation of hairstyling scissors for the third embodiment.

The second handle section can also be provided with a second curved section. The plan view of FIG. 19 shows this type of curved-handle hairstyling scissors 300 as the third embodiment. In this example, by establishing a second curved section 25' that curves part of the second handle section, wrapping the fingers around the curved section allows the hairstyling scissors to be held more easily. In particular, when the scissors are held by the right hand in a reverse orientation as shown in FIG. 20, namely when the hairstyling scissors are held with the blade-end pointed towards the user's wrist, the scissors can be held in a stable manner by inserting the ring finger in the second finger eyelet 27 and wrapping the middle finger around the second curved section 25'.

Figure 21:
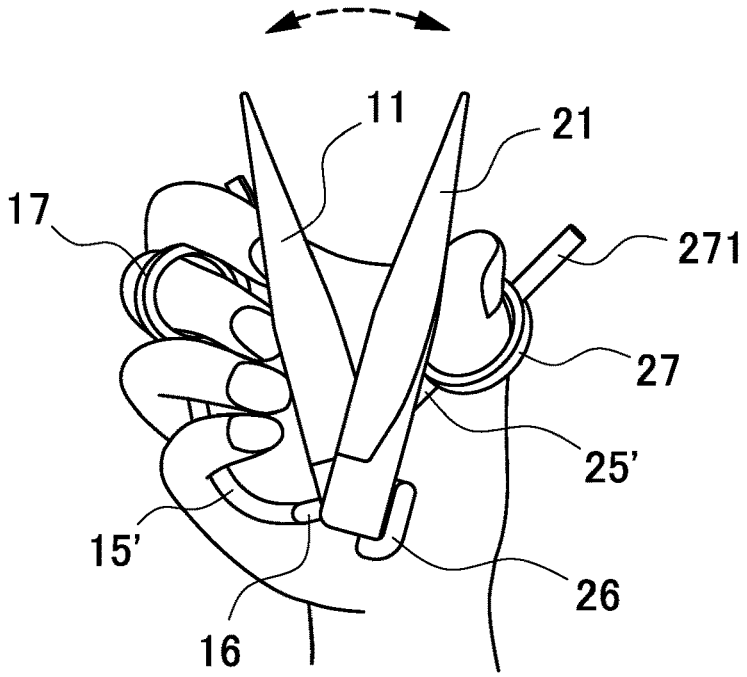
FIG. 21 is a drawing showing forward-grip operation of hairstyling scissors for the third embodiment.

The first handle section can also be curved. In the example of FIG. 19, the entire first handle section is formed as a first curved section 15'. When scissor orientation is swapped around and the scissors are held in a forward pointing orientation as shown in FIG. 21, namely when the hairstyling scissors are held with the blade-end pointed in the direction of the finger tips, the scissors can be held in a stable manner by inserting the middle finger in the first finger eyelet 17 and wrapping the ring finger around the first curved section 15'. Specifically, since the fingers extend from the palm of the hand in a curved fashion, making the first handle section curved instead of straight allows the fingers to naturally adapt and easily hold the hairstyling scissors in a stable manner. It should be apparent to those with an ordinary skill in the art that while various preferred embodiments of the invention have been shown and described, it is contemplated that the invention is not limited to the particular embodiments disclosed, which are deemed to be merely illustrative of the inventive concepts and should not be interpreted as limiting the scope of the invention, and which are suitable for all modifications and changes falling within the scope of the invention as defined in the appended claims. The present application is based on Application No. 2012-276287 filed in Japan on Dec. 18, 2012, the content of which is incorporated herein by reference.

The invention claimed is:

1. Hairstyling scissors comprising:

a first scissor piece to be used to cut hair;

a second scissor piece to be used to cut hair; and a pivot that connects the first scissor piece and the second scissor piece in a manner allowing the first scissor piece and the second scissor piece to rotate mutually in an unimpeded fashion, a cylindrical portion coupled to the pivot; wherein the first scissor piece is a long narrow piece comprising:

a first blade section positioned on a blade-side of the pivot; and a first handle section positioned on a gripping-side of the pivot and having a first arm attached to the cylindrical portion and a first finger eyelet;

wherein the first handle section is fixed in a first shape that bends to position the first finger eyelet beyond the pivot towards the first blade section;

the second scissor piece is a long narrow piece comprising:

a second blade section positioned on the blade-side of the pivot; and a second handle section positioned on the gripping-side of the pivot and having a second arm attached to a distal end of the second blade section and a second finger eyelet;

wherein the first blade section is extended from the pivot and the first handle section is bent at the first arm in a direction to which the first blade section is extended;

wherein the second blade section is extended from the pivot and the second handle section is bent at the second arm in a direction to which the second blade section is extended;

wherein the second handle section is fixed in a second shape that bends to position the second finger eyelet beyond the pivot towards the second blade section, and wherein the hairstyling scissors can cut hair introduced between the first scissor piece in the first shape and the second scissor piece in the second shape.

2. The hairstyling scissors as cited in claim 1 wherein the first scissor piece and the second scissor piece bend in approximate u-shapes.

3. The hairstyling scissors as cited in claim 1 wherein when viewed from above, the first handle section of the first scissor piece has the first shape that bends over to extend approximately parallel to the first blade section: and when viewed from above, the second handle section of the second scissor piece has the second shape that bends over to extend approximately parallel to the second blade section.

4. The hairstyling scissors as cited in claim 1 wherein a tilt angle adjustment section is further provided to control the relative tilting angle between the first blade section and the second blade section.

5. The hairstyling scissors as cited in claim 4 wherein the tilt angle adjustment section is supported by the pivot and is provided with:

a first tilting plate stacked on the first scissor piece with one part fixed to the first scissor piece; and an adjustment screw that screws into a screw-hole opened in the first tilting plate in a manner enabling the end of the adjustment screw to contact the first scissor piece;

and the tilt of the first blade section can be controlled by adjusting the amount that the adjustment screw is screwed in.

6. The hairstyling scissors as cited in claim 4 wherein the tilt angle adjustment section can also adjust the relative twist between the first blade section and the second blade section.

7. The hairstyling scissors as cited in claim 1 wherein the second handle section has a second curved section that establishes curvature at least in part(s) of the second handle section.

8. The hairstyling scissors as cited in claim 1 wherein the first handle section has curvature established by a first curved section.

9. The hairstyling scissors as cited in claim 1 wherein at least one or both the first finger eyelet and the second finger eyelet are detachable.

10. The hairstyling scissors as cited in claim 1 wherein a wing-nut is provided on an upper end of the pivot and applies pressure to the first scissor piece and the second scissor piece, and wherein tightening the wing-nut adjusts tightness between the first scissor piece and the second scissor piece.

11. The hairstyling scissors as cited claim 1 wherein the first blade section has a substantially straight shape, and the second blade section has a substantially straight shape.

* * * * *